United States Patent [19]

Faul et al.

[11] 4,265,722

[45] May 5, 1981

[54] METHOD OF PROCESSING THE SURFACE OF WORKPIECES INCLUDING PARTICULARLY THE ETCHING OF SURFACES CONTAINING COPPER OR COPPER ALLOYS

[75] Inventors: Wolfgang Faul; Leander Fürst, both of Jülich; Bertel Kastening, Hamburg, all of Fed. Rep. of Germany

[73] Assignee: Kernforschungsanlage Jülich Gesellschaft mit beschrankter Haftung, Jülich, Fed. Rep. of Germany

[21] Appl. No.: 96,137

[22] Filed: Nov. 20, 1979

[30] Foreign Application Priority Data

Nov. 22, 1978 [DE] Fed. Rep. of Germany ..... 2850542

[51] Int. Cl.[3] ..... C25F 3/14; C25F 5/00

[52] U.S. Cl. ..... 204/129.6; 204/129.75; 204/130

[58] Field of Search ..... 204/129.75, 129.8, 129.1, 204/129.6, 129.7, 232, 233, 237, 130

[56] References Cited

U.S. PATENT DOCUMENTS

| | | | |
|---|---|---|---|
| 3,622,478 | 11/1971 | Beyer | 204/237 |
| 3,788,915 | 1/1974 | Gulla | 204/130 |
| 3,974,050 | 8/1976 | Divisek | 204/129.6 |
| 4,131,523 | 12/1978 | Faul | 204/129.1 |
| 4,153,531 | 5/1979 | Faul | 204/275 |

*Primary Examiner*—T. M. Tufariello

*Attorney, Agent, or Firm*—Becker & Becker, Inc.

[57] ABSTRACT

Method of etching of surfaces of copper or copper alloys by way of an acidic solution containing an oxidizing agent. After removal of the copper surface, the etching solution is passed for regeneration of the oxidizing agent through an electrolysis cell having an anode and a cathode, with copper being deposited on the cathode. The etching solution is maintained free of chloride ions and contains as the oxidizing agent ferric sulfate in a concentration of up to about 140 g of Fe/1 etching solution, whereby the copper content of the etching solution is adjusted to at least 10 g Cu per liter etching solution, while the current density in the electrolysis cell is maintained at at least 2A/dm$^2$.

6 Claims, 4 Drawing Figures

METHOD OF PROCESSING THE SURFACE OF WORKPIECES INCLUDING PARTICULARLY THE ETCHING OF SURFACES CONTAINING COPPER OR COPPER ALLOYS

The present invention relates to a method of processing surfaces including particularly the etching of copper or copper alloy surfaces, by means of an acidic solution containing an oxidizing agent. After removal of the copper surface, the etching solution is passed, for regeneration of the oxidizing agent, through an electrolysis cell containing an anode and a cathode, whereby the copper is etched away from the surface and is recovered at the cathode.

The removal of copper by means of an etching solution from copper or copper alloy surfaces is known for the production of printed circuits, whereby from plates, of plastic or synthetic material, covered on one or both sides with copper, after covering of the surfaces which are to form the circuitry by means of a protective layer, the remainder of the copper coating or surface coating is etched away. The etching solution is also used for shaping the surface of printing plates or printing cylinders. In order to render the method economical, the used or spent etching solutions are regenerated and reconditioned. In such procedures the copper, which has been removed from the surface of the workpieces and contained in the etching solution, is then recovered.

Electrochemical methods are feasible for a continuous reconditioning of the etching solution, whereby the etching solution is introduced into an electrolysis cell and the oxidizing agent, which serves for etching, is regenerated at the anode. When ferric chloride ($FeCl_3$) is used as the etching agent, the ferrous chloride ($FeCl_2$) formed during etching is oxidized to ferric chloride. In a similar manner etching solutions, which contain cupric chloride ($CuCl_2$) as the oxidation agent, can be regenerated. The cuprous chloride (CuCl) contained in the electrolysis solution after removal of the copper surface is converted at the anode of the electrolysis cell again to cupric chloride. It is of disadvantage hereby, however, that chlorine is produced at the anode which leads to substantial environmental strain and to a consumption of the oxidizing agents. Prevention of chlorine production is known whereby an etching solution containing copper chloride as the oxidizing agent is regenerated by introduction into the cathode compartment of an electrolysis cell while adding hydrochloric acid and hydrogen peroxide, whereby the anode compartment of the electrolysis cell is separated from the cathode compartment by means of a diaphragm. The anode compartment contains a sodium hydroxide solution. The sodium hydroxide serves to receive or absorb the chlorine developing while regenerating the etching solution. The chlorine reacts with the sodium hydroxide and forms sodium hypochlorite. The high consumption of reagents is of detriment in these methods. Aside from sodium hyroxide also hydrochloric acid and hydrogen peroxide have to be added in order to maintain the etching conditions constant in the etching chamber. In addition the toxic effects of the sodium hypochlorite formed in the anode compartment are of disadvantage since the treatment thereof is cumbersome.

A further method for regenerating an etching solution containing cupric chloride as oxidizing agent in an electrolysis cell is known. In order to avoid the formation of chlorine gas at the anode, the copper content of the etching solution to be regenerated and the ratio of cuprous ions to cupric ions is limited to a narrow range. Furthermore, high current densities are required in the electrolysis cell. Aside from the expensive control for adjusting the predetermined concentration limits, as a result also the separation of copper, removed by etching from the workpiece at the cathode of the electrolysis cell, is difficult. Generally sludge-type precipitates are formed. It is further of disadvantage, when using etching solutions containing ferric chloride or cupric chloride as oxidizing agents, that these oxidizing agents attack the material of construction of the etching apparatus, unless these are made of an acid-resistant material, for example synthetic or plastic material, which, however, are not temperature-resistant.

It is an object of the present invention to provide a method for chemically processing, especially etching, metallic surfaces in which chlorine production at the anode is avoided in a simple manner, and wherein at the same time the components of the apparatus are not chemically attacked, even at high temperatures. Furthermore, it is an object of this invention to separate the copper in solid form during regeneration of the etching solution.

These objects and other objects and advantages of the invention will appear more clearly from the following specification in connection with the accompanying drawings, in which:

FIG. 1 diagrammatically indicates an apparatus for carrying out the method in accordance with one embodiment of the invention;

Figure 1:
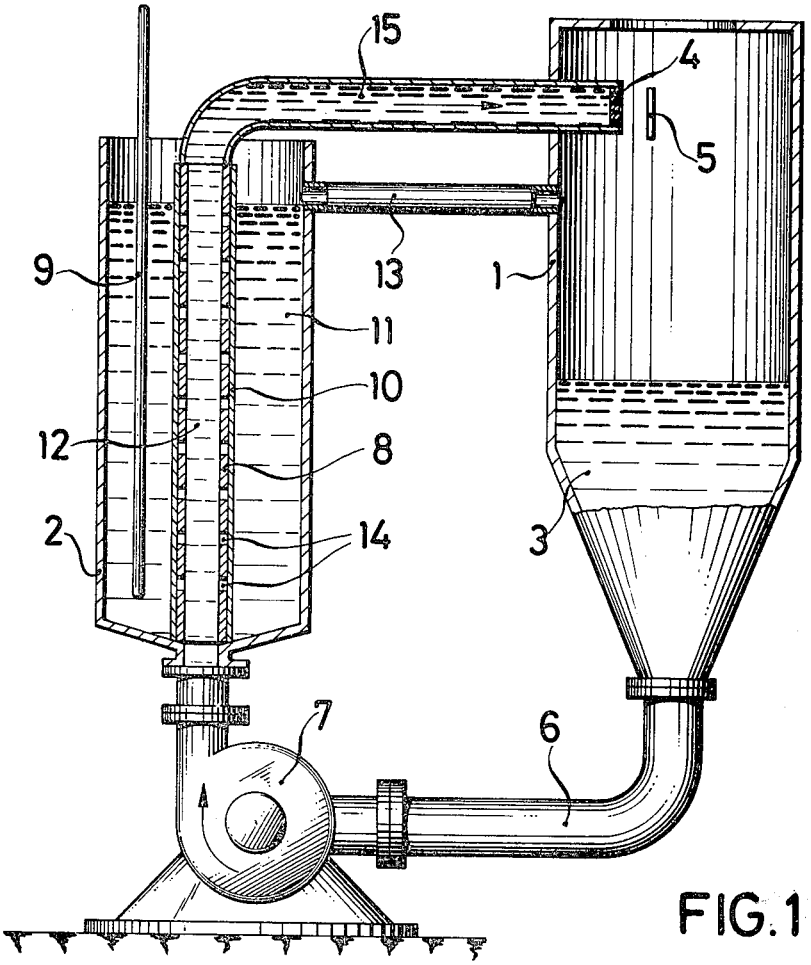

The method in accordance with the present invention is characterized primarily therein that the etching solution is maintained free of chloride ions and contains as the oxidizing agent ferric sulfate in a concentration of up to about 140 g of Fe/1 etching solution whereby the copper content of the etching solution is adjusted to at least 10 g Cu per liter etching solution, while the current density in the electrolysis cell is maintained at at least 2 $A/dm^2$.

By utilizing an etching solution which is free of chloride ions and which contains iron sulfate (ferric sulfate-$Fe_2(SO_4)_3$), even after complete oxidation of the ferrous sulfate contained in the used etching solution, no chlorine results at the anode. Instead, oxygen develops which can be released to the atmosphere. The etching velocity attainable is a function of the iron content of the etching solution. According to the invention the iron content is limited to maximally 140 g Fe per liter of etching solution, since it has been shown that on exceeding of this concentration the etching velocity decreases again. In the electrolysis cell the current is maintained at a minimum density to assure satisfactory recovery of the copper which is deposited at the cathode. In order to enhance the copper separation, the lower limit of concentration of copper in the etching solution is maintained.

In accordance with a further embodiment of the invention it is contemplated to add iron-containing compounds to the etching solution which form ferric sulfate at the anode when the etching solution flows through the electrolysis cell.

Iron oxide, iron carbonate, or iron ammonium sulfate can be used. It is preferred, however, to add ferrous sulfate ($FeSO_4.7\ H_2O$) to the etching solution.

In order to increase the etching rate, it is preferred that in the etching solution there are suspended, for transfer of electric charge onto the copper surface to be etched, electrically conductive carbon particles which are recharged from time to time at the anode of the electrolysis cell. Particularly preferred are pulverous particles of the group consisting of graphite and activated carbon, which can be present per liter of etching solution in amounts of from between 50 and 250 g, whereby the activated carbon powers are preferably treated, prior to being suspended, in a vacuum, at an inert or reducing atmosphere, at a temperature of from about 900° to about 1200° C., for at least one hour.

The carbon particles are suspended in the etching solution. When flowing through the electrolysis cell, the carbon particles are recharged at the anode and transfer electric charge onto the copper surface to be treated. On contact of the particles on the copper surface, metal ions enter the solution so that the surface, in addition to chemical etching with ferric sulfate, is electrochemically treated. Copper ions which have entered the solution are separated or deposited at the cathode in the electrolysis cell.

The method in accordance with the present invention accordingly provides for removal of copper layers by means of an etching solution passed through a circulating system, including direct recovery of the removed copper, which copper is recovered at the cathode, without formation of chlorine at the anode of the electrolysis cell. Etching solution containing ferric sulfate furthermore allows utilization of stainless steel for the components of the apparatus.

Referring now particularly to the drawings, the apparatus includes an etching chamber 1 and an electrolysis cell 2 between etching solution 3 moved in a circulating manner through the apparatus. In the etching chamber 1 the etching solution is brought into contact with the surface of a workpiece 5 to be worked on, by means of a spray nozzle 4. Used or spent etching solution flows to the bottom of the etching chamber 1. From here the solution is removed by way of conduit 6 and a pump 7 which is adapted to move the solution to the electrolysis cell 2. In electrolysis cell 2, between anode 8 and cathode 9, there is provided a partition 10 in the form of a diaphragm or ion exchange membrane which partition separates the cathode compartment 11 of electrolysis cell 2 from the anode compartment 12. An overflow conduit 13 is provided at the cathode compartment 11 for the solution contained therein. This concuit 13 is in communication with the etching chamber 1. In the embodiment indicated in FIG. 1, the anode 8 is comprised of graphite and is of tubular configuration whereby etching solution flows through the tubular anode 8. The wall of the graphite tube has bores or passages 14 which allow etching solution to be passed to the diaphragm or the ion exchange membrane, and to allow ion exchange between the cathode compartment 11 and the anode compartment 12. At the cathode 9 copper is separated from the solution while at the anode 8 the oxidizing agent of the etching solution is regenerated. The reconditioned etching solution flows from the anode compartment 12 through a pressure line or conduit 15 towards the nozzle 4 in the etching chamber 1.

An aqueous acidic (sulfuric acid-containing) ferric sulfate solution is used as etching solution. The solution moving through the circuit contains suspended therein electrically conductive carbon particles of a concentration of the range of 50 to 250 g/l of etching solution. The partition 10, either diaphragm or ion exchange member, is impermeable to the carbon particles. The carbon particles are positively charged at the anode 8 in the electrolysis cell 2 and carry electric charges to the copper surface of workpiece 5 to be treated. Aside from chemical etching, the copper is also electrochemically removed whereby the carbon particles release the electric charge carried by them.

EXAMPLE 1

Figure 2:
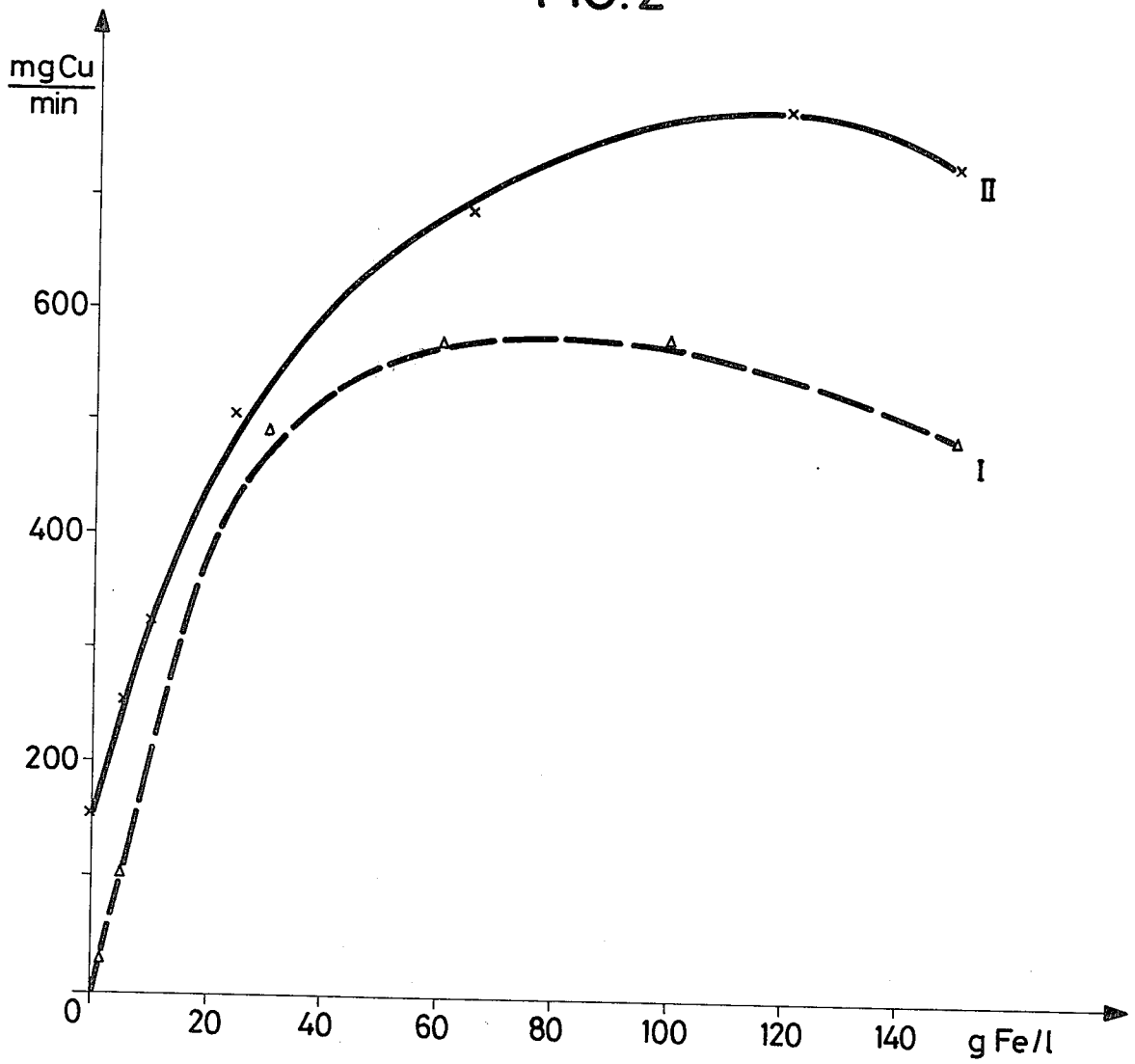
FIG. 2 is a graph indicating the relation of copper removal as a function of the iron content of the etching solution.

In the afore-described apparatus respectively 1.4 liter of a ferric sulfate solution (containing one Mol sulfuric acid per liter) was introduced. The iron content of the solution was increased from 5 to 150 g Fe/l etching solution. Workpieces of copper were etched with the etching solution being sprayed onto the surface at a temperature of 45° C. at a pressure of 1.5 bar, by means of the nozzle 4. The throughput was 1.9 l/min. In the electrolysis cell a constant potential difference of about +340 mV with respect to a reference electrode of $Hg/HgSO_4$ was maintained. The rate with which copper was removed from the workpiece surface was measured. The mean values, in mg Cu/min, are shown in FIG. 2 and are plotted in relation to the iron content per liter solution (g Fe/l), see Curve I.

It can be seen from Curve I that with increase of the iron content, the amount of copper removed is also increased; however, at about 80 g iron per liter etching solution a maximum is reached. The removal velocity then decreases with increase of the iron content. Optimal values for removal of the copper layer can be obtained at an iron content of from 30 to 140 g iron per liter etching solution.

EXAMPLE 2

15% by weight activated pulverous carbon particles were added to an acidic (sulfuric acid-containing) etching solution containing ferric sulfate. All other parameters were maintained in accordance with the parameters indicated in Example 1. The etching velocity obtained is indicated in FIG. 2 in curve II.

As can be seen from curve II the etching velocity is substantially increased by the addition of activated pulverous carbon particles. Hereby the etching velocity increases in the same manner as is indicated in Example 1 when the iron content of the solution increases. The optimal condition is attained at 120 g Fe per liter of etching solution.

EXAMPLE 3

In an acidic (sulfuric acid-containing) ferric sulfate-containing etching solution, at different iron contents in the etching solution, various copper concentrations were provided. The current yield, or electrolytic efficiency, was measured in relation to the recovery of copper at the cathode at various current densities in the electrolysis cell.

Figure 3:
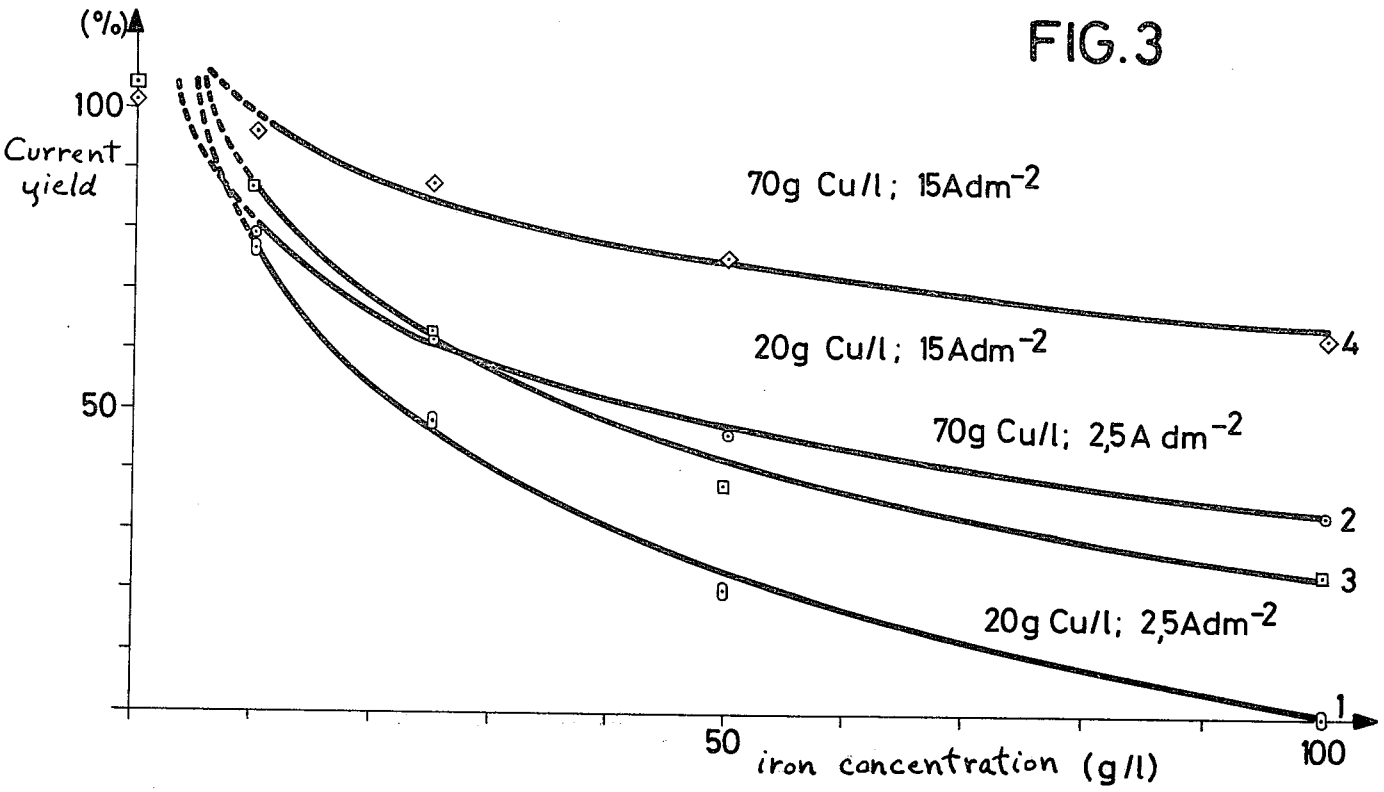
FIG. 3 is a graph indicating the current yield as a function of copper and iron content of the solution.

As is evident from FIG. 3, the current yield decreases as the Fe content of the etching solution, measured in g Fe/l, increases. This is opposed by the copper content in the etching solution, measured in g Cu/l, and the current density maintained in the electrolysis cell, measured in $A/dm^2$. The higher the copper content and the higher the current density are maintained, the higher the electrolytic efficiency will be. The functions indicated in FIG. 3, which show the dependency of the current yield upon the iron content of the etching solution, are respectively varied for constant values of copper content and current density. When the current density reaches the value zero, no copper separation occurs at the cathode.

EXAMPLE 4

Figure 4:
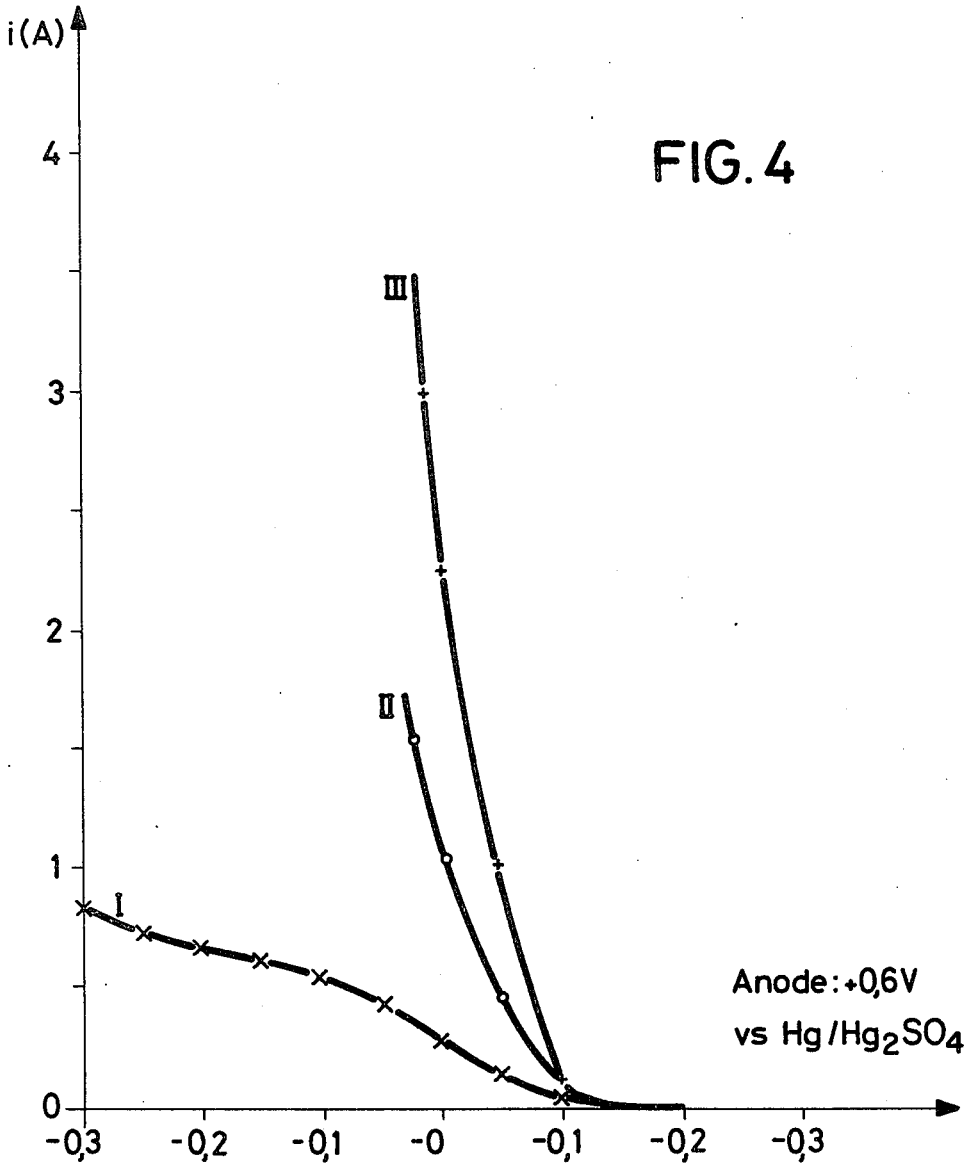
FIG. 4 is a graph indicating the charge transfer in the electrolysis cell.

In an acidic (surfuric acid-containing) etching solution containing ferric sulfate in a concentration of 10 g Fe/l there was suspended 15% by weight activated carbon. At the anode of the electrolysis cell a potential difference of +0.6 V relative to a reference electrode of Hg/Hg $SO_4$ was maintained. The charge transfer between the anode of the electrolysis cell and etching solution as a function of the separately measured potential of the etching solution was determined. The result is evident from FIG. 4. For comparison, in the diagram also the attainable charge transfer for etching solutions are indicated which are either only containing ferric sulfate as oxidizing agent, or only activated pulverous carbon particles. In the diagram the charge transfer i, in amperes (A), is indicated on the y-axis and the potential of the etching solution $E_s$, in volts (V), is indicated on the x-axis.

Curve I in the diagram indicates the charge transfer for an acidic (sulfuric acid-containing) but iron-free etching solution which contains suspended therein 15% by weight of activated carbon powder. Curve II indicates the charge transfer for an acidic (sulfuric acid-containing) etching solution with a content of ferric sulfate in a concentration of 10 g Fe/l etching solution. The charge transfer for the etching solution with 15% by weight suspended active carbon powder and ferric sulfate in a concentration of 10 g Fe/l is indicated in Curve III. The diagram indicates that with an acidic (sulfuric acid-containing) ferric sulfate-containing etching solution in which activated pulverous carbon powder is suspended, surprisingly high values for the charge transfer in the electrolysis cell can be achieved.

The present invention is, of course, in no way restricted to the specific disclosure of the specification and drawings, but also encompasses any modifications within the scope of the appended claims.

What we claim is:

1. A method of electrochemically processing metallic surfaces of workpieces including particularly etching of copper and copper alloy, in an electrolysis cell having an anode in a compartment thereof and a cathode comprising in combination the steps of:

providing in said electrolysis cell an acidic solution containing ferric sulfate as an oxidizing agent at a concentration of maximally 140 g Fe/l etching solution, and also containing at least 10 g Cu/l etching solution;

maintaining said solution free of chloride ions and at a current density of at least 2A/dm$^2$ in said electrolysis cell;

processing a workpiece by etching a metal surface with said solution so that copper is removed therefrom, resulting in a used etching solution;

passing said used etching solution through said electrolysis cell again to regenerate used etching solution including the oxidizing agent thereof; and depositing copper on said cathode of said electrolysis cell, suspending in said etching solution electrically conductive carbon particles added for transfer of electrical charge onto a pertaining surface to be processed for the purpose of regeneration of said used etching solution; and periodically charging suspended carbon particles at said anode of said electrolysis cell.

2. A method in combination according to claim 1, including the step of, prior to the first passing of the solution to be used as etching solution through said anode compartment, adding such a quantity of an iron compound adapted to form ferric sulfate at said anode as to enable withdrawing from said electrolysis cell etching solution containing iron, in the form of iron sulfate, at a concentration of from about 10 to about 140 g Fe/liter of etching solution.

3. A method in combination according to claim 2, including the step of adding ferrous sulfate to said etching solution.

4. A method in combination according to claim 1, including the step of suspending in said etching solution pulverous particles selected from the group consisting of graphite and activated carbon.

5. A method in combination according to claim 4, including the step of suspending about 50 to about 250 g of said pulverous particles.

6. A method in combination according to claim 4, which, prior to said suspending step, includes the step of heat treating said activated carbon in a vacuum in one of the atmospheres selected from the group consisting of inert and reducing atmospheres, at a temperature of from about 900° to about 1200° C., for at least one hour.

* * * * *